US008040031B2

(12) United States Patent
Sasai et al.

(10) Patent No.: US 8,040,031 B2
(45) Date of Patent: Oct. 18, 2011

(54) LAMP WITH OUTER TUBE AND ATTACHING MEMBER

(75) Inventors: Yasushi Sasai, Saitama (JP); Tsugio Sekiguchi, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 205 days.

(21) Appl. No.: 12/432,810

(22) Filed: Apr. 30, 2009

(65) Prior Publication Data

US 2009/0278435 A1 Nov. 12, 2009

(30) Foreign Application Priority Data

May 12, 2008 (JP) ..... 2008-124242

(51) Int. Cl.
*H01K 1/54* (2006.01)
*H01J 5/48* (2006.01)
*H01J 5/50* (2006.01)

(52) U.S. Cl. ..... 313/317; 313/318.01; 313/318.12; 313/25; 313/26

(58) Field of Classification Search ..... 313/318.1, 313/25–26
See application file for complete search history.

(56) References Cited

U.S. PATENT DOCUMENTS

| | | | | |
|---|---|---|---|---|
| 2006/0028113 | A1 | 2/2006 | Arndt et al. | |
| 2006/0077648 | A1 | 4/2006 | Stark | |
| 2006/0226754 | A1 * | 10/2006 | Arndt et al. | 313/318.09 |

FOREIGN PATENT DOCUMENTS

| | | |
|---|---|---|
| EP | 1983550 | 10/2008 |
| JP | 59-029336 | 2/1984 |
| JP | 6-111793 | 4/1994 |
| JP | 6-251756 | 9/1994 |
| JP | 9-17330 | 1/1997 |
| WO | 2007/088729 | 8/2007 |

OTHER PUBLICATIONS

Kihara et al., Japanese Patent Application Publication 06-111793,Apr. 1994, machine_translation.*
Search report from E.P.O., mail date is Jun. 1, 2010.

* cited by examiner

*Primary Examiner* — Anne Hines
*Assistant Examiner* — Tracie Green
(74) *Attorney, Agent, or Firm* — Greenblum & Bernstein, P.L.C.

(57) ABSTRACT

A lamp with an outer bulb is provided. The outer bulb is attached to an attaching member of a base by simple and convenient fabrication, and reliably prevents detachment of the outer bulb from the attaching member. An outer peripheral surface of a supporting post formed to the attaching member of the base and an inner peripheral surface of the outer bulb define a gap therebetween that may receive a heat resistant adhesive or filler. Convex portions facing the gap may be formed to the outer peripheral surface of the supporting post and the inner peripheral surface of the outer bulb, respectively, and a joint body for joining the outer bulb and the supporting post is defined between the outer peripheral surface of the supporting post and the inner peripheral surface of the outer bulb by the adhesive or filler in the gap.

8 Claims, 5 Drawing Sheets

--PRIOR ART--

LAMP WITH OUTER TUBE AND ATTACHING MEMBER

FIELD OF THE INVENTION

The present invention concerns a lamp with an outer bulb in which an outer bulb for housing a lamp main body is attached with an aim, for example, of protecting the lamp main body against external damages, preventing scattering of flakes due to bursting and breakage of the lamp main body and suppressing and decreasing emission of UV-ray harmful to human bodies.

DESCRIPTION OF THE RELATED ART

The lamp of the type described above includes, for example, a metal vapor discharge lamp such as a metal halide lamp in which a lamp main body having a light emitting tube or a lamp main body having a light emitting tube and an airtight bulb containing the light emitting tube is housed in an outer bulb that constitutes an outer shell of the lamp, and a halogen lamp in which a lamp main body having a light emitting filament and an airtight bulb containing the light emitting tube is housed in an outer bulb that constitutes an outer shell of the lamp. Generally, in the lamp having the outer bulb described above, an attaching member to which the lamp main body and the outer bulb for housing the lamp main body are attached is formed to a base of the lamp and an outer bulb is secured to the attaching member by means of a heat resistant adhesive. However, when the adhesive strength of the adhesive is lowered due to aging deterioration of the adhesive, the outer bulb may possibly be detached and dropped from the attaching member of the base.

Figure 5:
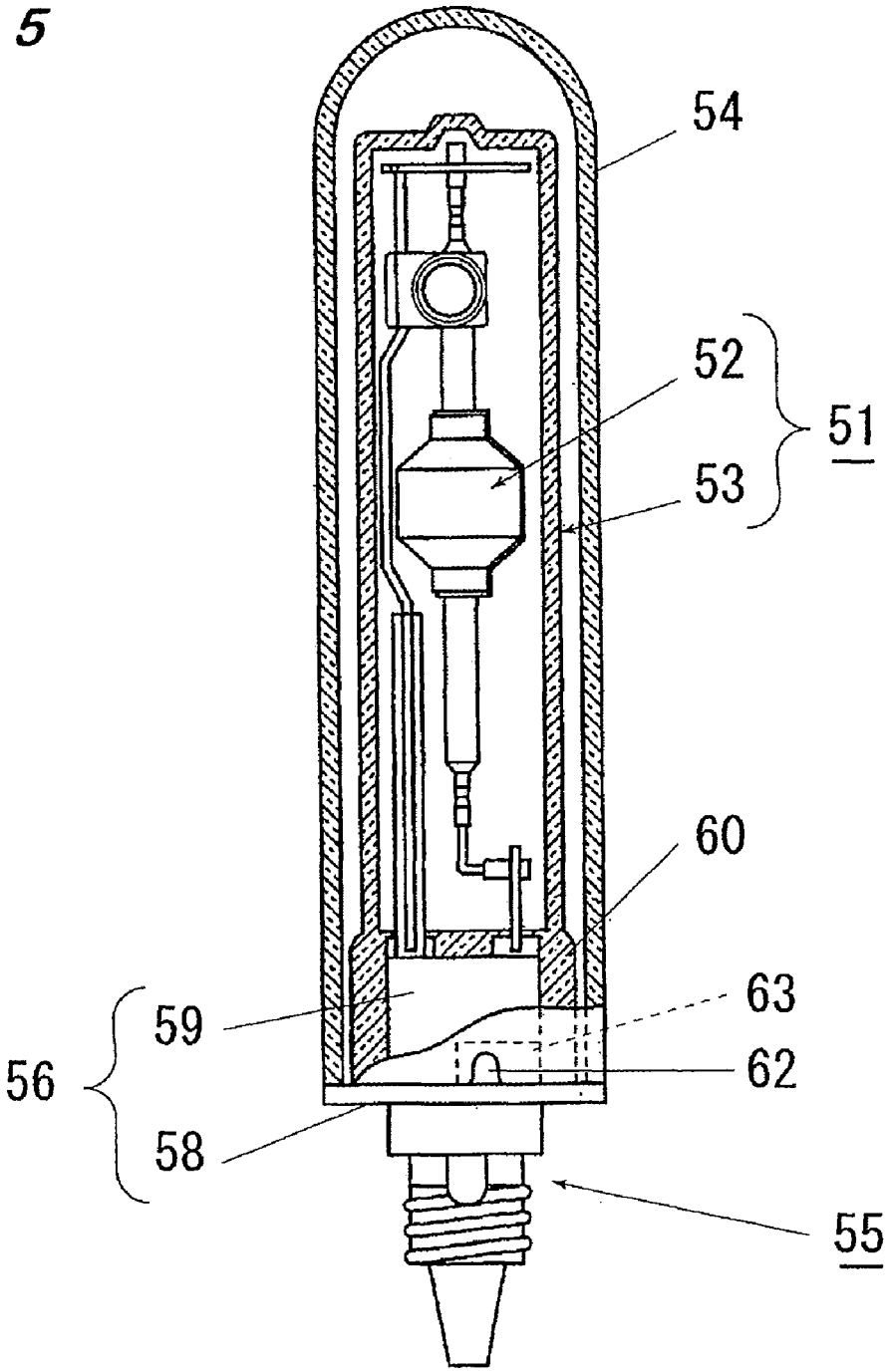
Figure 6A:
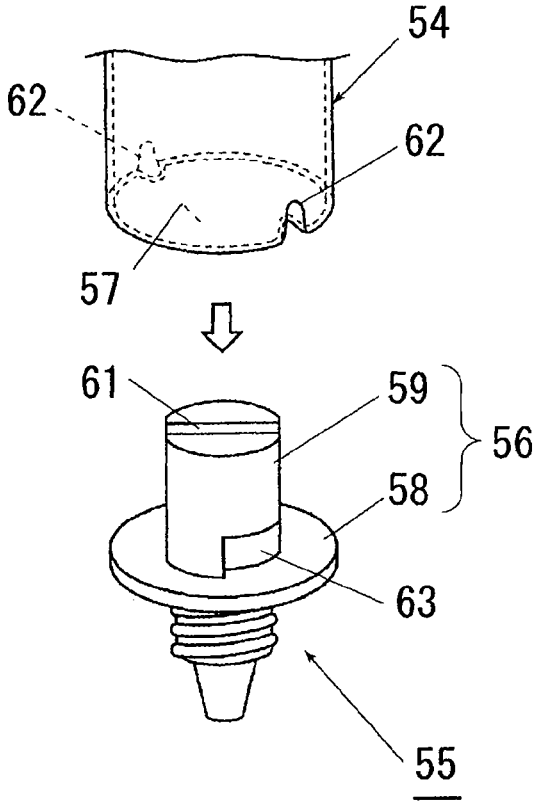
Fig. 6(a) (Prior Art)
Figure 6B:
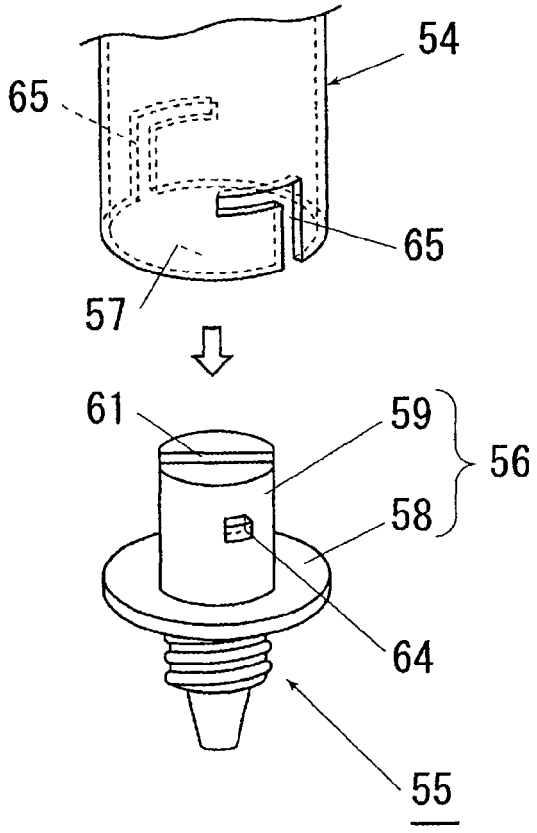
Fig. 6(b) (Prior Art)

Then, for preventing the detachment of the outer bulb caused by the degradation of the heat resistant adhesive, a metal vapor discharge lamp such as a metal halide lamp of securing an outer bulb by means of a bayonet mechanism to the attaching member of a base was disclosed as shown in FIG. 5 and FIG. 6 (Referring to Patent Literature 1). The lamp in FIG. 5 is a metal halide lamp in which a lamp main body 51 having a light emitting tube 52 made of ceramics containing a metal halide, mercury, and a starting gas sealed therein and an airtight bulb 53 made of quartz glass for containing the light emitting tube is housed in an outer bulb (protective tube) 54 made of hard glass having a strength capable of withstanding impact shocks upon explosion of the light emitting tube and capable of absorbing UV-rays at a low wavelength which are less absorbed by an airtight bulb made of quartz glass, and an attaching member 56 to which the lamp main body 51 and the outer bulb 54 for housing the lamp main body are attached is formed to a base 55 of the lamp.

In the attaching member 56 of the base 55, as shown in FIGS. 6(*a*) and 6(*b*), a circular cylindrical supporting post 59 for supporting and securing one end of the lamp main body 51 protrudes from a substrate (flange) 58 for closing an opening 57 of the outer bulb 54 and they are entirely formed integrally of steatite ceramics having a function as a porcelain insulator. Further, the supporting post 59 has a shape of a bisected circular cylinder by cutting a slit 61 for inserting a pinch seal 60 of the airtight bulb 53 that constitutes the lamp main body 51 from the top end thereof along the axial direction and securing the pinch seal 60 of the airtight bulb 53 by means of a heat resistant adhesive.

Two types of bayonet mechanism are disclosed for securing the outer bulb 54 to the attaching member 56 of the base 55.

One is a type to engage a protrusion 62 as a bayonet finger protruded to the inner side of an opening 57 of the outer bulb 54 to a concave portion 63 as a bayonet groove formed to the peripheral surface of the supporting post 59 of the attaching member 56 as shown in FIG. 5 and FIG. 6(*a*), and another is a type to engage a convex portion 64 as a bayonet finger protruded from the peripheral surface of the supporting post 59 of the attaching member 56 to an L-formed recess 65 as a bayonet groove formed by recessing the outer bulb 54 on the side of the opening into a hooked shape from the open end thereof as shown in FIG. 6(*b*).

Then, the outer bulb 54 is attached to the attaching member 56 of the base 55 by fabrication procedures of at first coating a heat resistant inorganic adhesive to the open end of the outer bulb 54 and the substrate (flange) 58 of the attaching member 56 of the base 55 against which the open end is to be abutted, bringing the open end of the outer bulb 54 into contact with the substrate (flange) 58 of the base 55, twisting (rotating) the outer bulb 54 in this state, and engaging the convex portion 62 formed as the bayonet finger to the outer bulb 54 and the concave portion 63 formed as the bayonet groove to the supporting post 59 of the attaching member 56 of the base 55 to each other in the type shown in FIG. 6(*a*), or engaging the convex portion 64 as the bayonet finger formed to the supporting post 59 of the attaching member 56 of the base 55 and the L-formed recess 65 as the bayonet groove formed to the outer bulb 54 to each other in the type shown in FIG. 6(*b*), thereby securing the outer bulb 54 by means of the bayonet mechanism to the attaching member 56 of the base 55, then baking the heat resistant inorganic adhesive coated as described above to connect the open end of the outer bulb 54 with the substrate (flange) 58 of the base 55 for preventing detachment of the outer bulb 54 from the attaching member 56 of the base 55 by the rotation of the outer bulb 54 in the direction of disengaging the engaged state between the bayonet finger and the bayonet groove caused by vibrations, etc. [Patent Literature 1] WO2007/088729

However, since the fabrication procedure of attaching the outer bulb 54 to the attaching member 56 of the base 55 by the double anti-falling off structure by means of the bayonet mechanism and the heat resistant adhesive is complicate in view of the fabrication step and takes much time, this may possibly lower the productivity of the lamps remarkably.

Further, in the anti-falling off structure by the bayonet mechanism, since the bayonet finger has to be engaged by screwing it into the bayonet groove, this may possibly damage the convex portion 62 as the bayonet finger formed to the outer bulb 54 of FIG. 6(*a*), or damage the L-formed recess 65 as the bayonet groove formed to the outer bulb 54 of FIG. 6(*b*) by inadequate control for the force that exerts upon screwing operation.

Further, since the convex portion 62 formed to the outer bulb 54 and the concave portion 63 formed to the supporting post 59 of the attaching member 56 of the base 55 in FIG. 6(*a*) have to be fabricated each into such a shape and a size as capable of engagement to each other so as to constitute the bayonet finger and the bayonet groove of the bayonet mechanism, or the L-formed recess 65 formed to the outer bulb 54 and the convex portion 64 formed to the supporting post 59 of the attaching member 56 of the base 55 in FIG. 6(*b*) have also to be fabricated each into a shape and a size as capable of engagement to each other so as to constitute the bayonet groove and the bayonet finger of the bayonet mechanism, this involves a problem of making the fabrication of them troublesome and increasing the fabrication cost, as well as a problem of causing a disadvantage of making the engagement between the bayonet finger and the bayonet groove difficult or impossible when the fabrication accuracy is poor, thereby lowering the production yield of lamps.

Further, in the anti-falling off structure by means of the heat resistant adhesive, the open end of the outer bulb 54 is bonded to the substrate (flange) 58 of the attaching member 56 of the base 55 by means of the heat resistant adhesive for preventing falling off of the outer bulb 54 from the attaching member 56 of the base 55 which is caused by rotation of the outer bulb 54 in the direction of disengaging the engaged state of the bayonet mechanism by vibrations, etc. However, when the adhesive loses the adhesive strength by aging deterioration, the outer bulb 54 may possibly rotate in the direction of disengaging the engaged state of the bayonet mechanism, thereby detaching the outer bulb 54 from the attaching member 56 of the base 55.

SUMMARY OF THE INVENTION

Problems to be Solved by the Invention

The present invention intends to attain a technical subject capable of attaching an outer bulb to an attaching member of a base not by means of the adhesive strength of the adhesive and, at the same time, capable of reliably preventing the detachment of the outer bulb by simple and convenient fabrication with no worry of damaging the outer bulb and without requiring strict fabrication accuracy.

Means for Solving the Problems

In accordance with the present invention, the technical subject described above is attained by a lamp with an outer bulb, in which an attaching member for attaching a lamp main body and an outer bulb for housing the lamp main body is formed to a base and a supporting post for supporting and securing the lamp main body is formed to a substrate for closing the opening of the outer bulb, wherein the outer peripheral surface of the supporting post and the inner peripheral surface of the outer bulb opposed to the outer peripheral surface define therebetween a gap for filling a heat resistant adhesive or filler, a concave portion or a convex portion facing the gap is formed to each of the outer peripheral surface of the supporting post and the inner peripheral surface of the outer bulb, and a joint body for joining the outer bulb and the supporting post is cast in mold being defined with the supporting post and the outer bulb by means of the adhesive or filler filled in the gap.

Advantageous Effect of the Invention

According to the invention, the outer bulb can be attached to the attaching member of the base and, at the same time, detachment of the outer bulb from the attaching member can be prevented by simple and convenient fabrication of merely forming a convex portion or a concave portion to each of the outer peripheral surface of the supporting post formed to the attaching member of the base and the inner peripheral surface of the outer bulb opposite thereto respectively, and filling the heat resistant adhesive or filler to the gap defined between the outer peripheral surface of the supporting post and the inner peripheral surface of the outer bulb.

Further, since the outer bulb is attached to the attaching member of the base not by means of the adhesive strength of the adhesive or the filler but by means of the joint body molded from the adhesive or the filler, even when the adhesive strength of the adhesive or filler is lost by aging deterioration, there is no possibility that the outer bulb should detach from the attaching substrate of the base.

Further, since detachment of the outer bulb is not prevented by the direct engagement of the convex portion or the concave portion formed to the outer peripheral surface of the supporting post and that formed to the inner peripheral surface of the outer bulb to each other, fabrication of forming the convex portion or the concave portion requires no strict accuracy. Further, when the outer bulb is attached to the attaching member of the base, there is no possibility that the convex portion or the concave portion formed to the outer bulb is broken.

PREFERRED EMBODIMENTS OF THE INVENTION

In preferred embodiments of a lamp with an outer bulb according to the present invention, a base has an attaching member to which are attached a lamp main body and an outer bulb housing the lamp main body, and the attaching member of the base has a supporting post formed to a substrate (flange) for closing an opening of the outer bulb for supporting and securing the lamp main body, and they are entirely formed of a porcelain material such as ceramics. The lamp main body includes, for example, a light emitting tube, a light emitting tube and an airtight bulb containing the light emitting tube, or a light emitting filament and an airtight bulb containing the light emitting filament, and the outer bulb for housing the lamp main body is formed of hard glass or quartz glass.

Then, the outer peripheral surface of the supporting post formed to the attaching member of the base and the inner peripheral surface of the outer bulb opposed to the outer peripheral surface of the supporting post define a gap therebetween for filling a heat resistant adhesive or filler, a concave portion or a convex portion facing the gap is formed to each of the outer peripheral surface of the supporting post and the inner peripheral surface of the outer bulb respectively. A joint body for joining the outer bulb and the supporting post is cast in mold defined with the supporting post and the outer bulb by means of a low temperature curable pasty inorganic heat resistant adhesive or filler filled in the gap.

The concave portion or the convex portion formed to the outer peripheral surface of the supporting post is formed as a substantially semi-spherical concave or convex portion, or as a concave groove or a convex ridge extending in the circumferential direction of the supporting post, the concave portion or the convex portion formed to the inner peripheral surface of the outer bulb is formed as a substantially semi-spherical concave or convex portion or as a concave groove or a convex ridge extending in the circumferential direction of the outer bulb. Each of the substantially semi-spherical concave portion or convex portion formed to the supporting post and the outer bulb is preferably formed in plurality each spaced at a pitch in the circumferential direction of the supporting post or the outer bulb. Further, each of the concave groove or the convex ridge formed to the supporting post and the outer bulb is preferably formed in plurality intermittently along the circumferential direction of the supporting post or the outer bulb, or formed as a continuous annular concave groove or convex ridge along the circumferential direction of the supporting post or the outer bulb.

Example 1

Figure 1A:
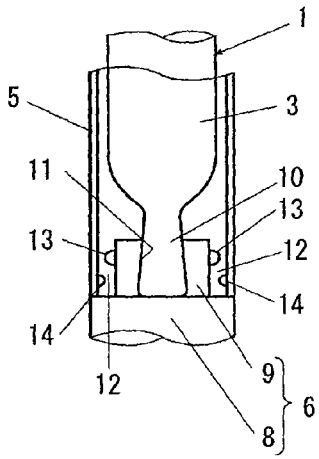
Figure 1B:
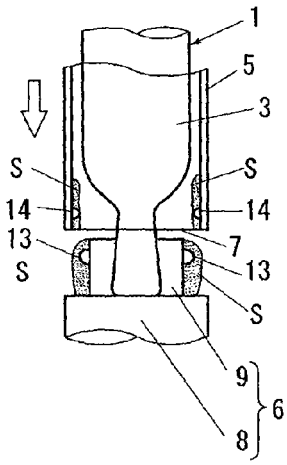
Figure 1C:
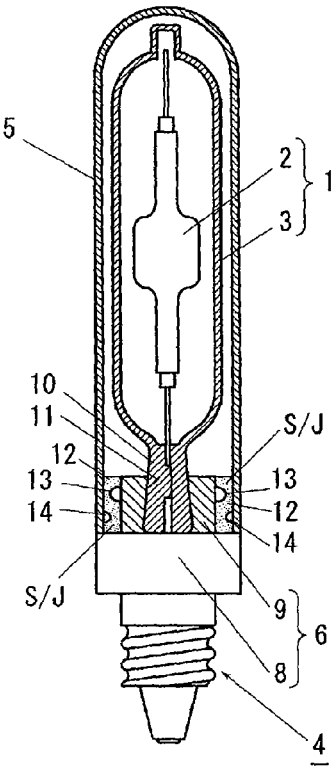
Figure 2A:
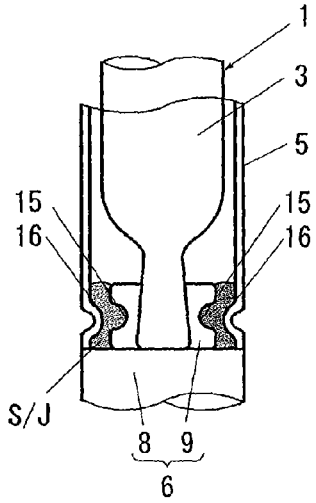
Figure 2B:
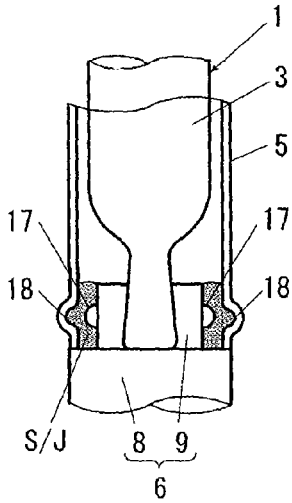
Figure 2C:
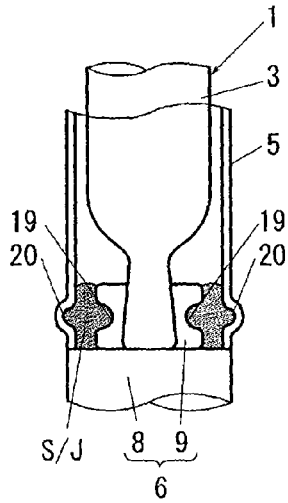

FIGS. 1A to 1C are views showing an embodiment of a lamp with an outer bulb according to the invention and FIGS. 2(*a*) to 2(*c*) are views showing modified examples for a main portion thereof. The lamp of this embodiment is a metal halide lamp, as shown in the entire view of FIG. 1(*c*), in which a lamp main body 1 has a light emitting tube 2 made of ceramics and an airtight bulb 3 made of quartz glass for containing the light emitting tube 2, and a base 4 has an attaching member 6 for attaching the lamp main body 1, and an outer bulb 5 made of hard glass or quartz glass for housing the lamp main body 1.

In the attaching member 6 of the base 4, a supporting post 9 for supporting and securing the lamp main body 1 is formed to a substrate (flange) 8 for closing an opening 7 of the outer bulb 5 and they are entirely formed of a porcelain material such as ceramics. A slit 11 is cut in the supporting post 9 from the top end thereof along the axial direction for inserting a pinch seal 10 of the airtight bulb 3 that constitutes the lamp main body 1 and securing the pinch seal 10 by means of a heat resistant adhesive.

Then, as shown in FIG. 1(*a*), a gap 12 is defined between the outer peripheral surface of the supporting post 9 and the inner peripheral surface of the outer bulb 5 opposite thereto for filling a heat resistant adhesive or filler, and a convex portion 13 and a convex portion 14 facing the gap 12 are formed to the outer peripheral surface of the supporting post 9 and the inner peripheral surface of the outer bulb 5 opposed to each other respectively. In the gap 12, a joint body J for joining the outer bulb 5, and the supporting post 9 is cast in mold defined with the supporting post 9 and the outer bulb 5 by means of a heat resistant adhesive or filler S filled as shown in FIG. 1(*c*). The convex portion 13 of the supporting post 9 is formed as a substantially semi-spherical convex portion or a convex ridge extending in the circumferential direction of the supporting post 9, and the convex portion 14 of the outer bulb 5 is formed as a substantially semi-spherical convex portion or a convex ridge extending in the circumferential direction of the outer bulb 5.

The heat resistant adhesive or filler S comprises a low temperature curable pasty inorganic adhesive or filler such as SUMICERAM (trade name of products, manufactured by Asahi Chemical Co., Ltd.) capable of curing at a low temperature, for example, of about 100 to 300° C. and capable of withstanding a high temperature of 1000 to 2000° C. When the paste-like adhesive or filler S is cast to the outer peripheral surface of the supporting post 9 and the inner peripheral surface of the outer bulb 5 divisionally each by an amount necessary for filling the gap 12 and the outer bulb 5 is capped over the lamp main body 1 and the supporting post 9 in the direction as shown by an arrow in the drawing as shown in FIG. 1(*b*), the pasty adhesive or filler S, S cast to the outer peripheral surface of the supporting post 9 and the inner peripheral surface of the outer bulb 5 divisionally are adhered and integrated to each other into a state in which the adhesive or filler S is cast in the gap 12 defined between the outer peripheral surface of the supporting post 9 and the inner peripheral surface of the outer bulb 5 as shown in FIG. 1(*c*).

When the adhesive or filler S is thermally cured at a low temperature in this state, the adhesive or filler S forms a joint body J for joining the outer bulb 5 and the supporting post 9, and the joint body J attaches the outer bulb 5 to the attaching member 6 of the base 4 and, at the same time, inhibits detachment of the outer bulb 5 from the attaching member 6.

As described above, since the outer bulb 5 is not bonded to the supporting post 9 by the adhesive strength of the adhesive or filler S but it is joined to the supporting post 9 by means of the joint body J which is cast in mold by means of the adhesive or filler S, even when the adhesive strength of the adhesive or filler S is lost by aging deterioration, there is no possibility that the outer bulb 5 is detached from the attaching member 6 of the base 4. Further, even when the adhesive or filler S retains no substantial adhesion effect at all, detachment of the outer bulb 5 can be inhibited reliably to improve the quality of products and the reliability of the lamp remarkably.

Further, since the outer bulb 5 is not attached to the attaching member 6 of the base 4 by direct engagement of the convex portion 14 formed to the inner peripheral surface thereof to the outer peripheral surface of the supporting post 9, there is no possibility that the convex portion 14 of the outer bulb 5 is damaged upon attachment to the attaching member 6.

Further, since it may suffice that the convex portion 14 of the outer bulb 5 and the convex portion 13 of the supporting post 9 have such a size as capable of casting the joint body J in mold for joining the outer bulb 5 and the supporting post 9 and no strict dimensional accuracy is necessary, fabrication of shaping the convex portion 14 and the convex portion 13 is relatively easy and fabrication failure less occurs. Further, since the joint body J for joining the outer bulb 5 and the supporting post 9 is cast in mold and the outer bulb 5 is attached to the attaching member 6 of the base 4, as well as detachment of the outer bulb 5 from the attaching member 6 is inhibited reliably by simple and convenient fabrication of merely filling the adhesive or filler S between the inner peripheral surface of the outer bulb 5 and the outer peripheral surface of the supporting post 9 formed with the convex portion 14 and the convex portion 13, and curing the adhesive or filler S, the fabrication cost for attaching the outer bulb 5 is not increased and there is no worry that the productivity of the lamp is lowered.

In the lamp shown in FIG. 1, while the convex portions 13, 14 are formed to both of the supporting post 9 and the outer bulb 5, this may be modified, for example, by shaping a concave portion 15 to the outer peripheral surface of the supporting post 9 and shaping a convex portion 16 to the inner peripheral surface of the outer bulb 5 as shown in FIG. 2(*a*), by shaping a convex portion 17 to the outer peripheral surface of the supporting post 9 and shaping a concave portion 18 to the inner peripheral surface of the outer bulb 5 as shown in FIG. 2(*b*), or by forming concave portions 19, 20 both to the outer peripheral surface of the supporting post 9 and the inner peripheral surface of the outer bulb 5 as shown in FIG. 2(*c*). Further, the convex portion 16 of the outer bulb 5 shown in FIG. 2(*a*) may be a substantially semi-spherical convex portion, or a convex ridge extending in the circumferential direction of the outer bulb 5 formed by thermally softening a portion of the outer bulb 5, each of the concave portions 18 and 20 of the outer bulb 5 shown in FIG. 2(*b*) and FIG. 2(*c*) may be a semi-spherical concave portion or a concave groove extending in the circumferential direction of the outer bulb 5 formed by thermally softening a portion of the outer bulb 5, and the concave portion 19 of the supporting post 9 shown in FIG. 2(*c*) may be a semi-spherical concave portion, or a concave groove extending in the circumferential direction of the supporting post 9.

Example 2

Figure 3:
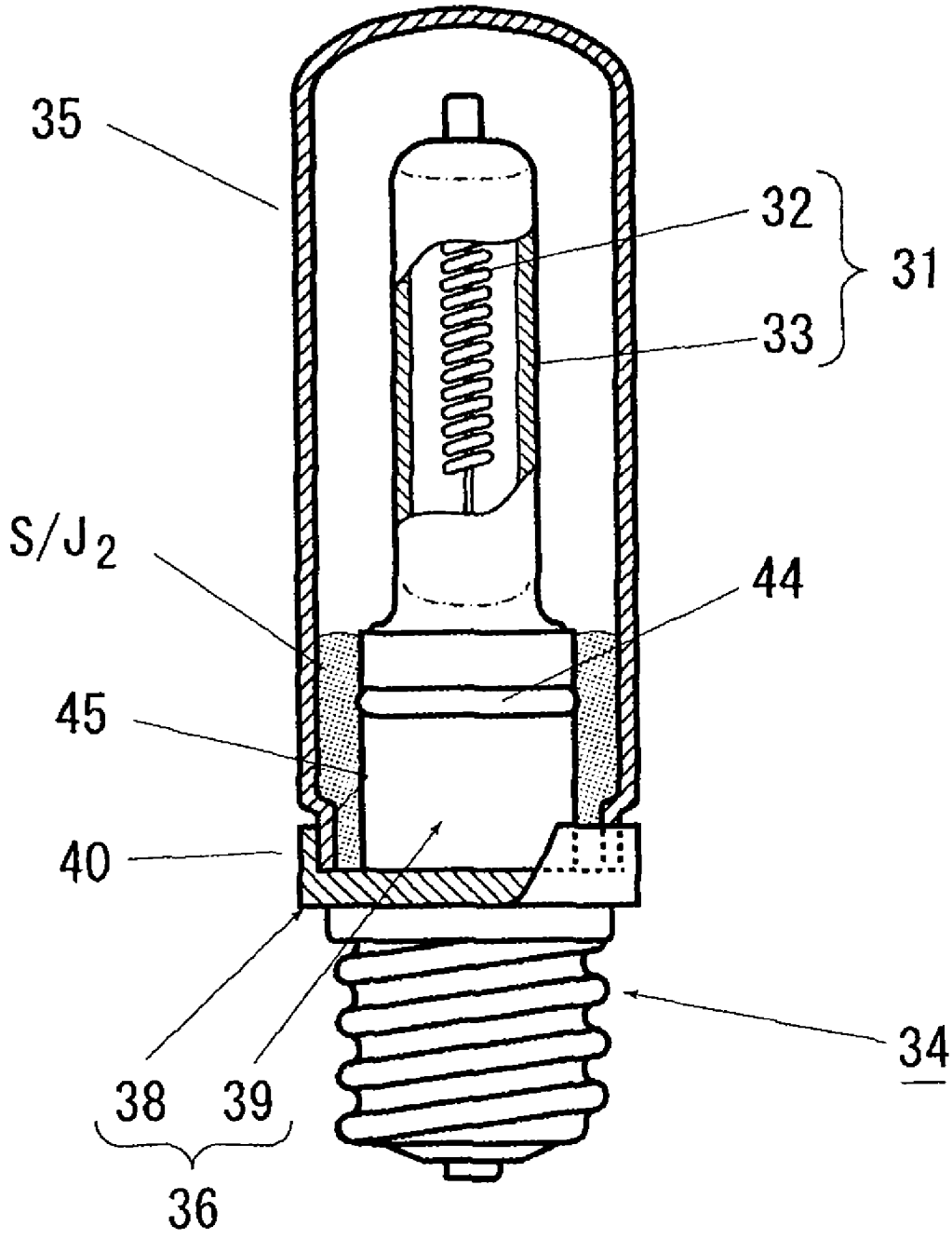
Figure 4A:
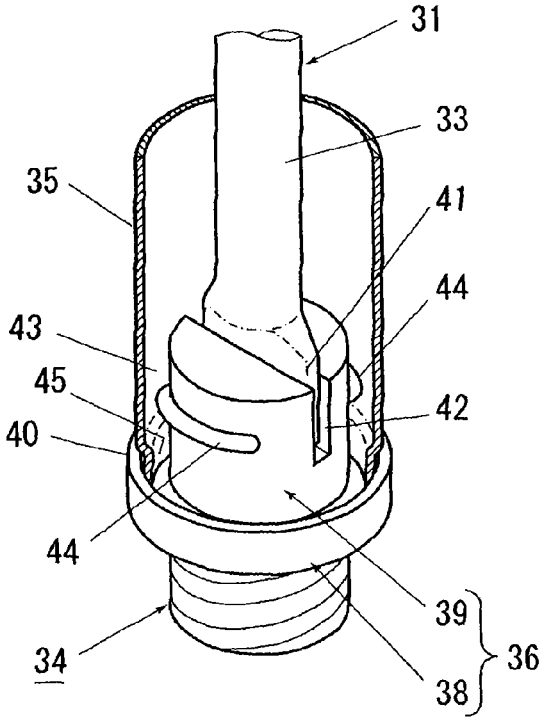
Figure 4B:
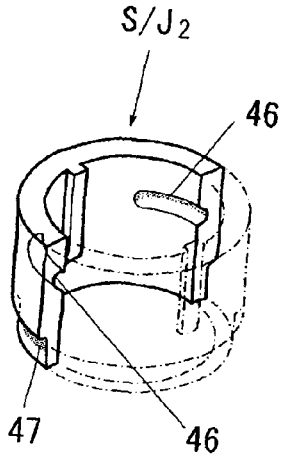

FIG. 3 is an entire view showing another embodiment of a lamp with an outer bulb according to the invention, FIG. 4(*a*) is a view showing the structure for a main portion of the lamp and FIG. 4(*b*) is a structure of a joint body cast in mold by means of a heat resistant adhesive or filler. The lamp in FIG. 3 is a halogen lamp in which a lamp main body 31 has a light emitting filament 32 and an airtight bulb 33 made of quartz glass for containing the filament. An attaching member 36 is formed to a base 34 for attaching the lamp main body 31 and an outer bulb 35 made of hard glass for housing the lamp main body 31.

In the attaching member 36 of the base 34, a circular cylindrical supporting post 39 for supporting and securing the lamp main body 31 is formed at the central region of a substrate (flange) 38 for closing the opening of the outer bulb 35, an annular peripheral wall 40 is formed along the outer periphery of the substrate (flange) 38 for inwardly fitting the open end of the outer bulb 35, and the attaching member 36 is entirely formed of a porcelain material such as ceramics. Further, a slit 42 is cut in the supporting post 39 from the top end along the axial direction thereof for inserting a pinch seal 41 of the airtight bulb 33 that constitutes the lamp main body 31 and securing the pinch seal 41 by means of a heat resistant adhesive.

Then, as shown in FIG. 4(*a*), a gap 43 is defined between the outer peripheral surface of the supporting post 39 and the inner peripheral surface of the outer bulb 35 opposed to the outer peripheral surface of the supporting post for filling a heat resistant adhesive or filler, a convex portion 44 and a convex portion 45 facing the gap 43 are formed respectively to the outer peripheral surface of the supporting post 39 and the inner peripheral surface of the outer bulb 35 opposed to each other. Then, a joint body $J_2$ for joining the outer bulb 35 and the supporting post 39 is cast in mold within the gap 43 as shown in FIG. 4(*b*) by means of the heat resistant adhesive or filler S filled as shown in FIG. 3.

The convex portion 44 of the supporting post 39 is formed as a convex ridge extending in the circumferential direction of the supporting post 39. Further, the convex portion 45 of the outer bulb 35 is formed by the fabrication of tapering, that is, diametrically decreasing the open end of the outer bulb 35 for fitting the open end of the outer bulb 35 toward the inside of the circumferential wall 40 of the substrate (flange) 38 formed to the attaching member 36 of the base 34, and this forms an annular convex portion protruding toward the inside of the outer bulb 35.

Then, a concave portion 46 comprising a concave groove for engagement with the convex portion 44 formed to the outer peripheral surface of the supporting post 39 and an annular step 47 for engagement with the annular convex portion 45 formed to the inner peripheral surface of the outer bulb 35 are formed to the joint body $J_2$ cast in mold by means of the adhesive or filler S filled in the gap 43 defined between the outer peripheral surface of the supporting post 39 formed to the attaching member 36 of the base 34 and the inner peripheral surface of the outer bulb 35 opposed to the outer peripheral surface of the supporting post 39.

Thus, the joint body $J_2$ can attach the outer bulb 35 to the attaching member 36 of the base 34 and, at the same time, can inhibit detachment of the outer bulb 35 from the attaching member 36 of the base 34. Further, the joint body $J_2$ can reliably prevent detachment of the outer bulb 35 even when the heat resistant adhesive forming the joint body loses the adhesion effect thereof due to aging deterioration, or even when it is formed of a heat resistant filler not having an adhesive function.

While each of the outer bulbs 5 and 35 of the embodiments has a cylindrical shape, the outer bulb of the invention is not restricted to the cylindrical outer bulb. Further, the outer bulb of the invention also includes those referred to as an outer sphere, an outer spherical bulb, and an outer bulb.

INDUSTRIAL APPLICABILITY

The present invention can simplify the fabrication of attaching the outer bulb of the lamp with the outer bulb to the attaching member of the base and, at the same time, can reliably prevent detachment of the outer bulb attached to the attaching member of the base, thereby contributing to the improvement of the quality and the reliability of the lamp with the outer bulb.

DESCRIPTION OF THE ACCOMPANYING DRAWINGS

FIGS. 1(*a*)-(*c*) show an embodiment of a lamp with an outer bulb according to the invention;

FIGS. 2(*a*)-(*c*) show modified examples for a main portion of the lamp shown in FIG. 1;

FIG. 3 is a view showing another embodiment of a lamp with an outer bulb according to the invention;

FIGS. 4(*a*)-(*b*) show the constitution for a main portion of the lamp shown in FIG. 3 and structure of a joint body thereof;

FIG. 5 is a view showing an existent lamp with an outer bulb;

FIGS. 6(*a*)-(*b*) are fragmentary views showing examples for a main portion of an existent lamp with an outer bulb.

DESCRIPTION OF THE REFERENCES

1 lamp main body
2 light emitting tube
3 airtight bulb
4 base
5 outer bulb
6 attaching member
7 opening of outer bulb
8 substrate (flange)
9 supporting post
10 pinch seal of airtight bulb
12 gap
13 convex portion
14 convex portion
15 concave portion
16 convex portion
17 convex portion
18 concave portion
19 concave portion
20 concave portion
S heat resistant adhesive or filler
J joint body
31 lamp main body
32 light emitting filament
33 airtight bulb
34 base
35 outer bulb
36 attaching member
38 substrate (flange)
39 supporting post
41 pinch seal of airtight bulb
43 gap
44 convex portion
45 convex portion
$J_2$ joint body

What is claimed is:

1. A lamp with an outer bulb, comprising:

an attaching member that attaches a lamp main body and an outer bulb for housing the lamp main body with a base, a supporting post that supports and secures the lamp main body to a substrate that closes an opening of the outer bulb, wherein an outer peripheral surface of the supporting post and an inner peripheral surface of the outer bulb that opposes the outer peripheral surface define therebetween a gap configured to receive at least one of a heat resistant adhesive and a filler, at least one of a concave portion and a convex portion facing one another across the gap is provided at each of the outer peripheral surface of the supporting post and the inner peripheral surface of the outer bulb, and a joint body that engages both of the facing concave and convex portions provided at the outer peripheral surface of the supporting post and the inner peripheral surface of the outer bulb, respectively, is defined between the supporting post and the outer bulb by one of the adhesive and filler received in the gap.

2. The lamp with the outer bulb according to claim 1, wherein the attaching member is formed of a porcelain material such as ceramics and the outer bulb is formed of at least one of a hard glass and a quartz glass.

3. The lamp with the outer bulb according to claim 1, wherein the adhesive or filler is a low temperature curable pasty inorganic adhesive or filler.

4. The lamp with the outer bulb according to claim 1, wherein the concave portion or the convex portion provided at the outer peripheral surface of the supporting post is a semi-spherical concave portion or a semi-spherical convex portion, respectively.

5. The lamp with the outer bulb according to claim 1, wherein the concave portion or the convex portion formed to the outer peripheral surface of the supporting post is a concave groove or a convex ridge extending in a circumferential direction of the supporting post.

6. The lamp with the outer bulb according to claim 1, wherein the concave portion or the convex portion provided at the inner peripheral surface of the outer bulb is a semi-spherical concave portion or a semi-spherical convex portion, respectively.

7. The lamp with the outer bulb according to claim 1, wherein the concave portion or the convex portion provided at the inner peripheral surface of the outer bulb is a convex groove or a convex ridge extending in a circumferential direction of the outer bulb.

8. The lamp with the outer bulb according to claim 1, wherein the lamp main body includes one of a light emitting tube and a light emitting filament, and an airtight bulb containing the one of the light emitting tube and the light emitting filament.

* * * * *